United States Patent [19]

Patel

[11] 4,438,811

[45] Mar. 27, 1984

[54] LATCH FOR USE IN A WELL

[75] Inventor: Dhirajlal C. Patel, Carrollton, Tex.

[73] Assignee: Otid Engineering Corporation, Dallas, Tex.

[21] Appl. No.: 408,455

[22] Filed: Aug. 16, 1982

[51] Int. Cl.[3] ..... E21B 23/06

[52] U.S. Cl. ..... 166/123; 166/134; 166/237; 285/321

[58] Field of Search ..... 166/123–125, 166/134, 237, 317, 323; 285/3, 39, 315, 321

[56] References Cited

U.S. PATENT DOCUMENTS 3,678,998 7/1972 Cockrell et al. ..... 166/134 X 3,845,815 11/1974 Garwood ..... 166/237 X

*Primary Examiner*—Ernest R. Purser

*Assistant Examiner*—Thuy M. Bui

*Attorney, Agent, or Firm*—Vinson & Elkins

[57] ABSTRACT

A packer utilizing a C-slip in which, during release of the packer, the upper expander pulls the C-slip off of the lower expander. If a packer is stuck in the well, the upper expander is keyed to the slip to prevent rotation of the upper expander during milling. A latch for releasing the packer may be operated mechanically or hydraulically and the latch is protected against sand.

12 Claims, 9 Drawing Figures

LATCH FOR USE IN A WELL

This invention relates to latches for use in a well. In one form, the latch provides a part of a well packer.

Releasble well packers and other equipment conventionally use latches which are released to rease the equipment from the wall of a well. See, for instance, U.S. Pat. No. 3,678,998 which, in FIG. 1 shows a latch for a packer which is released to permit the packer to be removed from a well.

Latches of the type shown in U.S. Pat. No. 2,999,554 are exposed to the flowing well fluids and may become sanded up and difficult to release.

Where a flow tubing and a retrievable packer such as shown in this patent are subjected to high temperature conditions, the expansion of the tubing causes it to elongate to such an extent that packing on the tubing for engagement on the smooth bore through the packer may move to a position below the smooth bore of the packer. It would be desirable to accommodate this phenomena by a smooth bore tail pipe depending from the packer.

An object of this invention is to provide an anchor or a packer in combination with an anchor in which fluid integrity is maintained between the mandrel of the anchor the bottom sleeve of the anchor to protect the latch system against encroachment by sand and other debris.

Another object is to provide an anchor or a packer having an anchor in which fluid integrity is maintained between the mandrel and the lower sub and any tail pipe which may depend from the lower sub to permit sealing between a tubing in the anchor or packer and the smooth bore in the mandrel or in a tail pipe depending therefrom.

Another object is to provide an anchor or a packer having an anchor in which the latch is shifted to release the anchor and in which the release sleeve for the anchor may be released by shifting it up or down.

Another object is to provide an anchor or a packer with an anchor in which the shifting sleeve for the anchor sealingly engages the mandrel on which the anchor is carried and the sleeve depending from the anchor so that the sleeve may be shifted either by engagement with a shifting shoulder on the sleeve or by landing a plug below the sleeve and pressuring up the string to apply pressure to the pressure responsive area defined by the seals on the sleeve to shift the sleeve to release position.

Other objects, features and advantages of the invention will be apparent from the drawings, the specification and the claims.

In the drawings, wherein like reference numerals indicate like parts, and wherein an illustrative embodiment of this invention is shown:

Figure 1A:
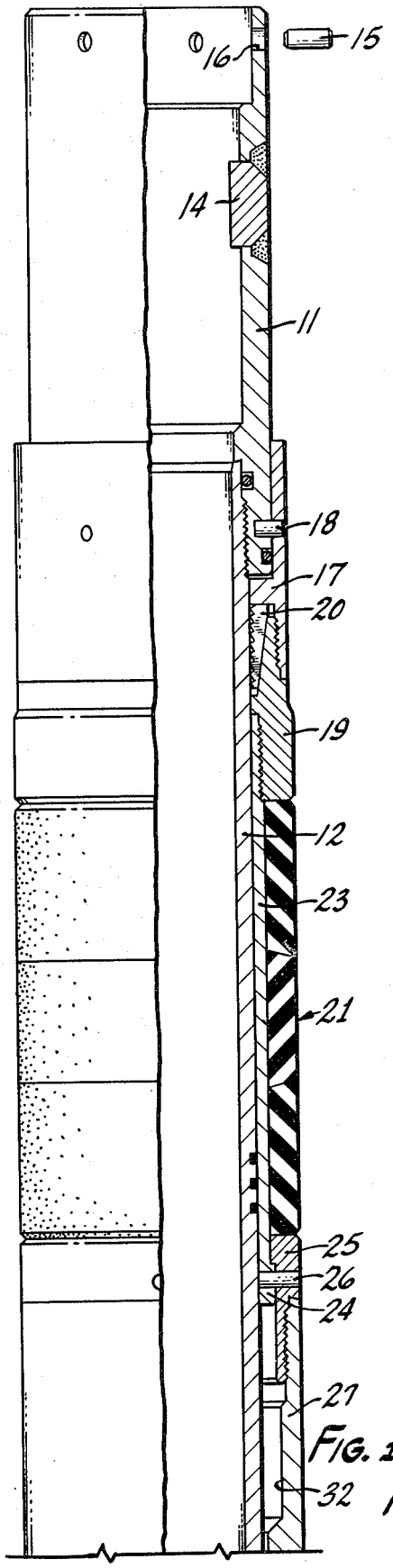
FIGS. 1A and 1B are continuation views partly in elevation and partly in section of a packer constructed in accordance with this invention and shown with the parts positioned for running the packer into the hole.
Figure 1B:
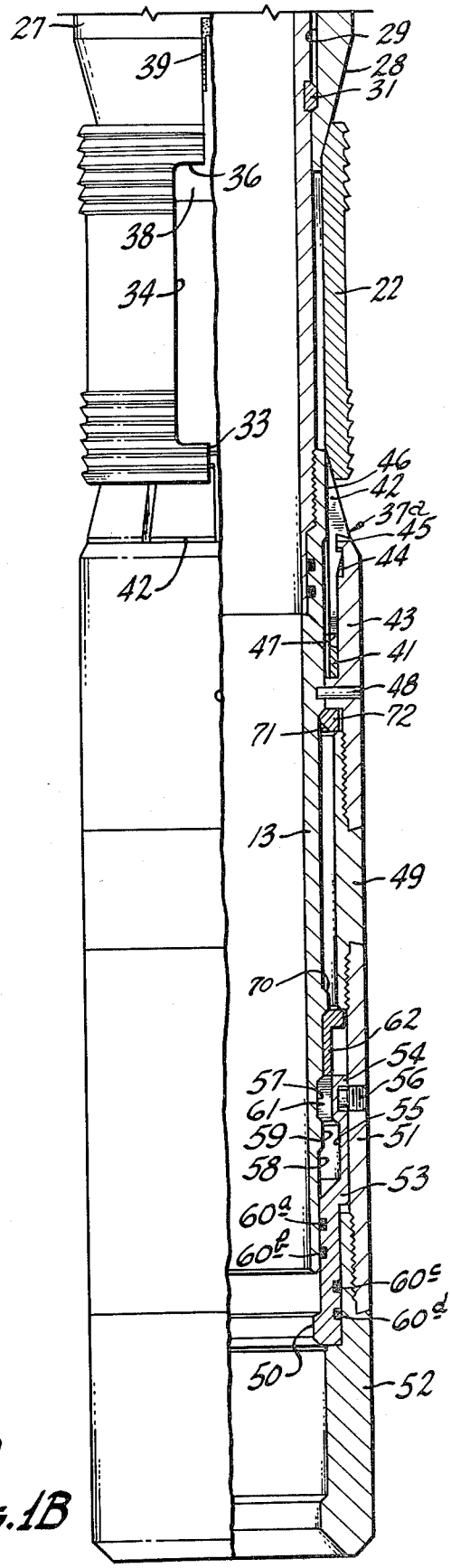

Referring first to FIGS. 1A and 1B, the latch for releasing the anchor is shown to be associated with packing elements so that the entire assembly is a packer but it will be understood that the latch system may be utilized in any instance when it is desired to anchor a member in a well.

A mandrel is provided by a top sub 11, a sleeve 12 depending from the top sub and a latch sleeve 13 secured to the lower end of sleeve 12.

The top sub 11 carries an internal lug 14 which will be utilized with a J-slot on a tubing landed in the upper end of the packer to latch a tubing to the packer, and which may be utilized with a pulling tool to pull the packer from the well.

At the upper end of the top sub 11, a shear pin 15 is shown which extends through a hole 16 and latches the packer to a running tool. After the packer has been set, the pin 15 is sheared to releae the running tool from the packer.

A wireline adapter 17 is secured to the top sub 11 by shear pin 18. Secured to the lower end of the wireline adapter is the internal slip retainer 19 which carries the internal slip 20.

The setting tool utilizes a sleeve which telescopes over the top sub 11 and engages the upper end of the wireline adapter 17. When the packer is in the desired position, the setting tool is activated to drive the wireline adapter 17 downwardly to compress the packing elements indicated generally at 21 and to set the C-slip 22. As the slip retainer 19 moves downwardly, the wireline adapter 17 will carry the internal slip 20 downwardly with the slip retainer 19. In the conventional manner, the exterior surface of the internal slip 20 and the interior surface of the upper end of internal slip retainer 19 have mating frusto conical surfaces which wedge the internal slip 20 against the mandrel sleeve 12 and prevent upward movement of the internal slip retainer 19 relative to the sleeve 12 to hold the packer in set position.

Depending from the internal slip retainer 19 is a packer sleeve 23 which supports the packer elements 21 against collapse and which effects the expansion of the C-ring 22.

At its lower end, the packer sleeve 23 has an enlarged flange 24 which cooperates with an internally projecting flange on the upper end of the packer element retainer 25. As is conventional, the packer elements 21 are compressed between the internal seal retainer 19 and the packer element retainer 25 when these two parts are moved toward each other.

The packer element retainer 25 is also pinned to the packer sleeve 23 by the shear pin 26 which is sheared after the C-ring is set to permit the internal slip retainer 19 to move downwardly toward the packer element retainer 25 to expand the packing elements 21.

Depending from the packer element retainer 25 is the upper expander 27. This expander has on its lower end the frusto conical section 28 for expanding the C-ring 22.

The lower end of expander 27 has its bore 29 spaced from the mandrel sleeve 12 to provide space for the snap ring 31 on the mandrel sleeve 12 to reciprocate relative to the upper expander 27. Above the bore 29, the upper expander 27 has a still further enlarged bore 32 to provide space for the packer sleeve 23 to move downwardly relative to the upper expander 27.

The C-ring 22 is preferably fabricated with teeth facing in opposite directions to engage the wall of a casing. The C-ring 22 should be very strong and is shown in FIG. 1B in its relaxed running position. The high strength of the C-ring will prevent it from being accidentally expanded to cooperate with either the upper or lower expanders during running or pulling of the tool. This will prevent the tool from inadvertently latching when going through obstructions such as a sand bridge, tight spots in the casing or the like.

At the split 33 in the C-ring, the ring is provided with a slot. This slot is provided by cutting out a portion of the C-ring at 34 and 35 in the C-ring on opposite sides of the split 33. The slot terminates below the upper end of the C-ring to provide the shoulders 36 and 37.

Means are carried by the mandrel for cooperating with the slot and shoulders 36 and 37 to suspend the C-ring 22 and to pull the C-ring 22 off of the lower expander indicated generally at 37*a*. In the preferred form of the tool, the means is provided by a T-shaped lug 38 which is secured to the upper expander 27 as by welding the vertical leg of the T to the upper expander as at 39. The cross of the T-shaped lug 38 reciprocates in the slot 34–35 and is engageable with the shoulders 36 and 37 in the C-ring to support the C-ring when the tool is being run as shown in FIG. 1B and to pull the C-ring off of the expander.

The lower expander may be a solid cone-shaped member such as the expander surface 28 of the upper expander 27 but it is preferred that the expander cone be collapsible at least to a limited extent, and for this purpose, the lower expander is provided by a collet 41 having collet fingers 42 with upwardly and inwardly facing frusto conical surfaces thereon to engage the mating surface in the bore through the C-ring 22 to expand the C-ring. The collet 41 is mounted in a collet carrier 43 having an internal groove 44 therein which cooperates with an external groove 45 in the outer diameter surface of the collect fingers 42 in an interlocking fashion to secure the collet fingers to the collet carrier.

Figures 2A, 2B:
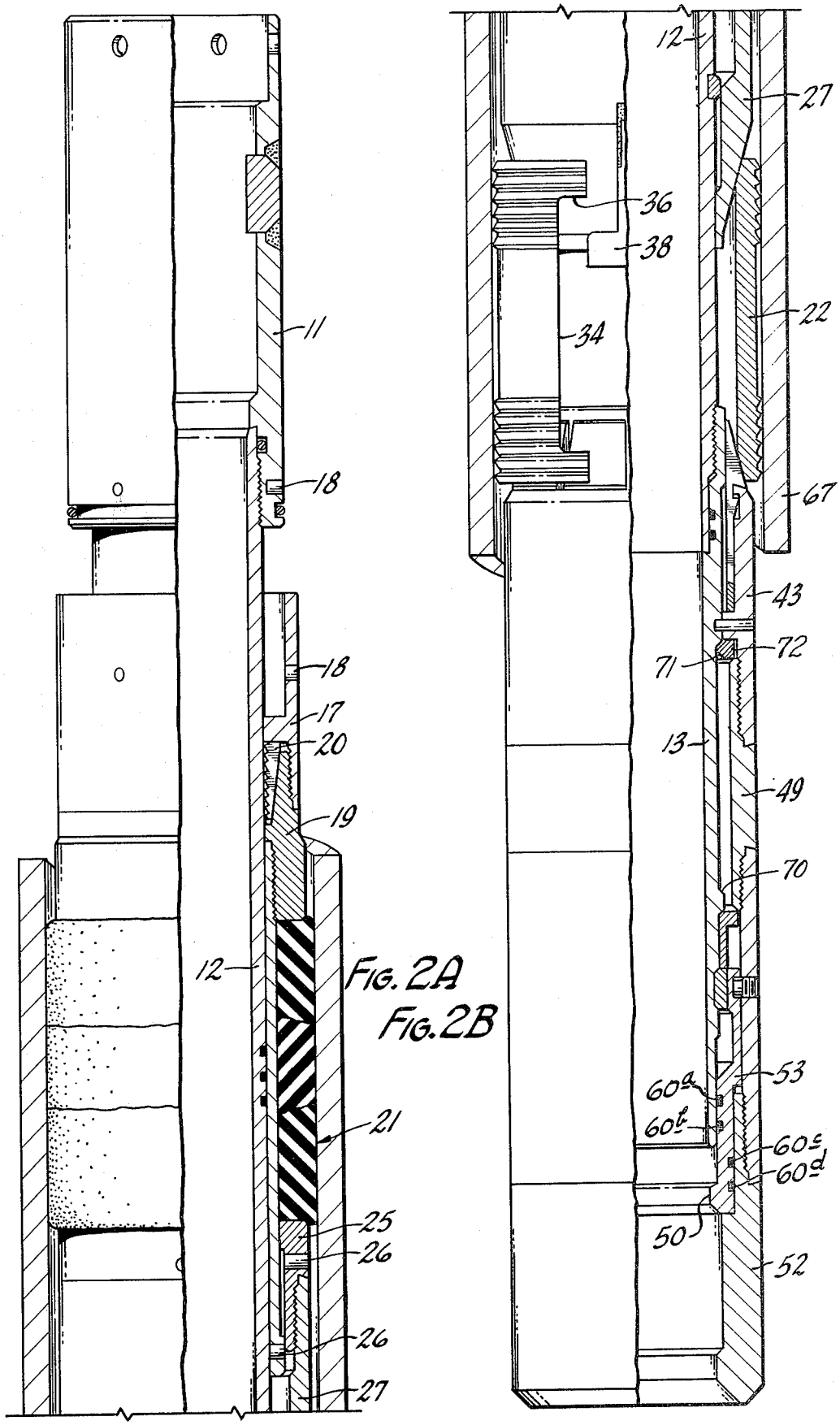
FIGS. 2A and 2B are views similar to FIGS. 1A and 1B showing the packer set in the hole.
Figure 5:
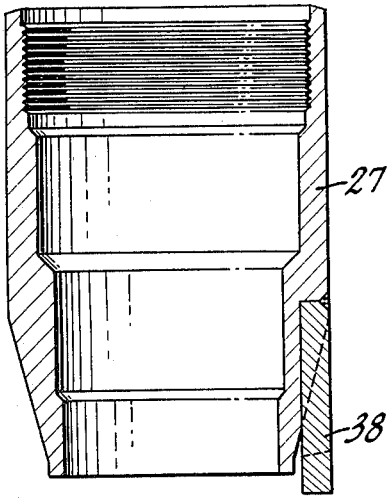
FIG. 5 is a view along the lines 5—5 of FIG. 4.
Figure 4:
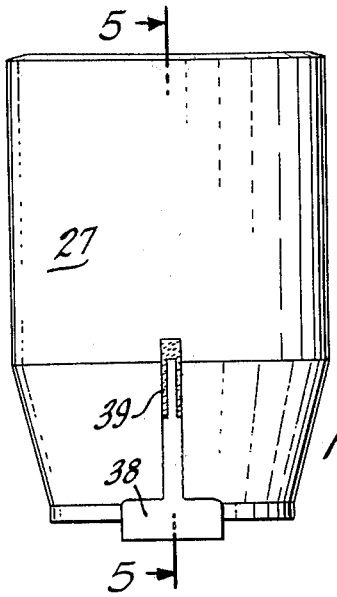
FIG. 4 is an elevational view of the upper expander and lug.
Figure 3:
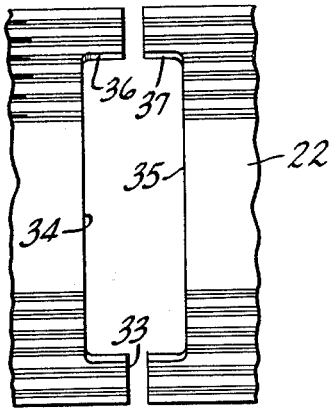
FIG. 3 is a fragmentary elevational view of the slotted portion of the C-slip.

The upper end of the latch sleeve 13 is enlarged at 46 to provide a collet prop-out which maintains the collet fingers 42 in their expanded position during running of the tool as shown in FIG. 1B and while set as shown in FIG. 2B. When the tool is pulled, the latch sleeve 13 moves upwardly and has a reduced diameter section 47 which moves under the expander surfaces of the collet fingers 42 to permit them to collapse against this surface to permit the C-ring 22 to contract and reduce the frictional forces between the collet fingers 42 and the C-ring.

The collet carrier 43 is pinned to the latch sleeve 13 by the shear pin 48 while the tool is being run and set.

At the bottom of the packer, means are provided for releasing the packer by releasing the mandrel from the lower expander and permitting the mandrel to move the upper expander from under the slips and to pull the slip off of the lower expander utilizing said lug and thereafter support the slip 22 on the lug 38.

While the latch is shown with a packer, it will be appreciated that the latch might be used with any tool which is to be positioned in a well and released by the manipulation of a latch.

In the illustrated embodiment shown in FIGS. 1A and 1B and in FIGS. 2A and 2B, the mandrel includes the latch sleeve 13 which has the external grooves 57 and 58 with the land 59 therebetween.

A latch ring such as the split ring 61 is positioned in the groove 57.

An outer sleeve depends from the collet carrier 43 and includes the connector 49, the shear sleeve 51 and the bottom sub 52. The outer sleeve is telescoped over the lower end of the latch sleeve and has a stop shoulder provided by the ring 62 which prevents upward movement of the latch ring 61 relative to the outer sleeve.

A ring retainer 53 is slidable over the latch sleeve 13 and within the outer sleeve. The ring retainer 53 has an internal retainer land 54 for engagement with the latch ring 61 to retain it in the groove 57.

Means are provided for releasably positioning the ring retainer 53 with the retainer land 54 in engagement with the latch ring 61. In the preferred form, this releasable means is provided by the shear pin 56.

Seal means are provided in the ring retainer 53 which are slidable in the latch sleeve 13 as by the O-rings 60*a* and 60*b*. Seal means is also provided in the ring retainer 53 which are slidable in the outer sleeve by O-rings 60*c* and 60*d*. These seals provide fluid tight integrity between the latch sleeve and the outer sleeve. This prevents any sand or other debris from the fluid passing through the tool, settling out in the latch section to cause trouble when the latch is to be released. They further provide a pressure responsive member defined by the difference in area between seals 60*a*–60*b* and 60*c*–60*d* for operating the latch with the pressure fluid. As will be understood by those skilled in the art, a plug can be landed in the lower sub 52 and with the lower end of the latch closed, pressure within the tool may be increased and be effective on the ring retainer 53 to move the ring retainer upwardly and shear pin 56 to release the latch.

The ring retainer 53 is provided with an inwardly facing flange 50 which may be engaged by a conventional running tool to move the ring retainer upwardly to shear pin 56 and release the ring retainer for movement to the release position.

When the tool is to be unlatched, a retrieving tool is run in and engages the internal flange 50 on the lower end of the snap ring retainer 53. Upward movement of the retainer 53 shears the pin 56 moving the retainer 53 up to register the groove 55 with the snap ring 61. The mandrel can then be moved upwardly relatively to the lower retainer by shearing pin 48. The stop ring 62 will prevent upward movement of the snap ring 61 while moving the latch sleeve 13 up to the point at which the snap ring 61 drops into the groove 58 permitting free upward movement of the mandrel and the latch sleeve 13 as the groove 58 is provided by a reduced diameter section extending to the bottom of the latch sleeve 13.

The shear pin 48 mintains a relationship of the lower expander 37*a* and shear sleeve 51 with the latch sleeve 13 while the snap ring retainer 53 is being shifted. After the ring has been shifted to release the latch sleeve 13, movement of the latch sleeve will shear the pin 48 and release it from the lower retainer.

In operation, the tool is made up on a suitable running tool having a sleeve depending over the top sub 11 and in engagement with the wireline adapter 17. When the packer reaches the desired position in the well, the running tool is actuated. For instance, the running tool might employ a hydraulic piston, explosives or an electric motor to drive the sleeve of the running tool downwardly relative to the top sub 11 and shear pin 18 driving the wireline adapter 17 and the internal seal retainer 19 downwardly. This moves the packer sleeve 23 and the upper expander 27 downwardly. Downward movement of the upper expander 27 drives the C-ring 22 onto the cone of the lower expander 37 and the upper expander 27 will have its expander surface 28 also driven behind the C-ring 22 to firmly expand the C-ring into engagement with the casing of a well. As the C-ring is quite strong, several thousand pounds of force will be necessary to set the C-ring. After the C-ring is set and further downward movement of the upper expander 27 is arrested, the shear pin 26 between the upper expander and the packer sleeve 23 will release and continued downward movement of the internal sleeve retainer 19 will expand the packing elements 21 into engagement with the casing to seal therewith. The internal slip 20 will then cooperate with the slip retainer 19 to hold the slip retainer 19 downwardly in packer expanding position.

After the packer is set, the pins 15 in the top sub 11 are sheared and the running tool removed. Thereafter, a production tubing will be run in and a J-slot on the tubing will cooperate with lug 14 to latch the tubing to the packer.

When it is desired to remove the packer, the tubing is unlatched from latch 14 and removed. A pulling tool will then be run into the well and secured to the lug 14 by a suitable J-slot in the pulling tool. The pulling tool will have at its lower end a means for engaging the bottom of the snap ring retainer 53 and move the retainer 53 to its up position to release the latch. Thereafter, an upward force is applied to the lug 14 and thus to the mandrel to move the mandrel upwardly relative to the remainder of the tool. The shear pin 48 which has been holding the lower retainer and mandrel in the relationship shown in FIG. 1B while the snap ring retainer is shifted, is now sheared to permit the mandrel to move upwardly.

Upward movement of the mandrel brings the upper end of the latch sleeve 13 into contact with the lower end of the upper expander 27 and pulls the upper expander from behind the C-ring 22. Prior to this time, the prop-out surface 46 moves from under the collet fingers 42, they collapse, releasing the C-ring from the casing 67 and reducing the frictional engagement between the C-ring and the collet fingers. When the prop-out moves up to the upper end of the C-ring and pulls the upper expander from behind the C-ring 22, the upper end of the C-ring is permitted to collapse and release the casing 67. At this time, the lug 38 comes into engagement with shoulders 36 and 37 and pulls the C-ring off of the lower expander 37*a* and supports the C-ring above the lower expander so that the C-ring may pass through obstructions in the well as it is pulled from the well without thereafter being expanded.

As the mandrel is pulled upwardly, the snap ring 31 carried on the mandrel sleeve 12 moves into abutment with the lower end of the packer sleeve 23 and moves it upwardly with the mandrel to release the packer elements 21 and permit them to return to the position shown in FIG. 1A.

Referring to FIG. 2B, it will be noted that in set position the C-ring has been expanded so that the groove 34–35 is no longer in contact with the head of the T-shaped lug 38. In retrieving the packer, the prop-out releases the lower collet permitting the lower portion of the C-ring to be free to contract. The lug moves upwardly with the upper expander 27 and thus the C-ring is released to contract prior to the lug 38 reaching the shoulders 36 and 37. If desired, the relationship of the depth of the groove and the width of the head of the lug 38 may be such that the lug will engage the shoulders 36 and 37 even with the C-ring in full expanded position. Upward movement of latch sleeve 13 shears pin 48, and the sleeve moves upward until shoulder 70 on the sleeve engages surface 71 of split ring 72 and suspends the connector 49 and structures secured thereto on the sleeve.

By providing the lug receiving slot in the C-ring at the split in the ring and utilizing the shoulders at the upper end of the slot to engage the lug to pull the C-ring off of the lower expander and support it thereabove during point of the tool, a very strong C-ring may be utilized. The ring is not weakened by providing a slot other than at the split section and there are no stress concentration points such as might be present if an internal flange were provided in the C-ring. Thus, a very strong dependable C-ring may be utilized as a slip and will have the strength necessary to hold it in collapsed unstressed condition so that the C-ring will not interfere with running or pulling the tool through tight places, sand bridges or the like indication.

Figure 6:
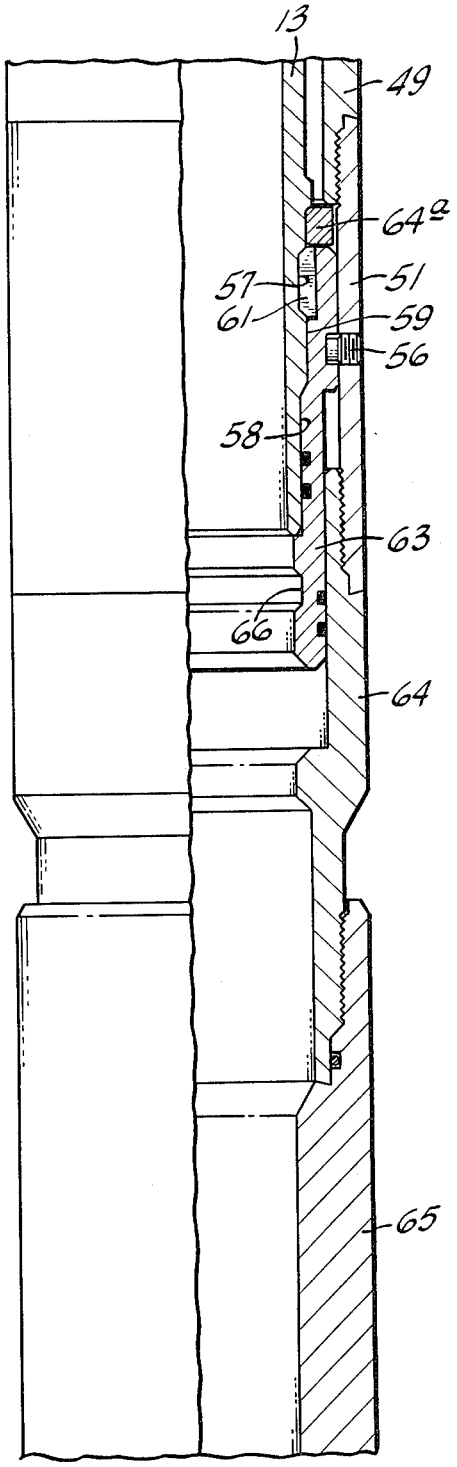
FIG. 6 is a view partly in elevation and partly in section of a modified form of latch for the packer.

In FIG. 6, a modified form of release means is shown which releases by moving a snap ring retainer 63 downwardly. Other than the design of the retainer 63, and the inclusion of a spacer ring 64*a*, the release portion of the tool is the same as described. The bottom sub 64 is threaded at its lower end and supports a tail pipe 65 if desired.

The snap ring retainer 63 has an internal groove 66 which will be engaged by a running tool and a downward jarring of the running tool will result in shearing of pin 56 and downward movement of the snap ring retainer 63 to release snap latch ring 61. Thereafter, the latch sleeve 13 may be freely moved upwardly past the snap latch ring 61 and spacer 64*a* to release the tool from the well.

The tail pipe 65 provides a smooth bore which may be engaged by packing on the production tubing (not shown) so that engagement of the packing with the smooth bore provided by the mandrel is not critical and the packing may either engage the smooth bore of the mandrel or the smooth bore of the tail pipe 65 which may have any desired length. As fluid integrity is provided by the seals 60*a*, 60*b*, 60*c* and 60*d*, the seal between the production tubing and the smooth bore may be within the mandrel or within the tail pipe 65 or either of them and thus the tool may be used in high temperature situations where the tubing will expand to a considerable extent and the seals might be effective in either the mandrel smooth bore or the smooth bore provided by the tail pipe 65.

Figure 7:
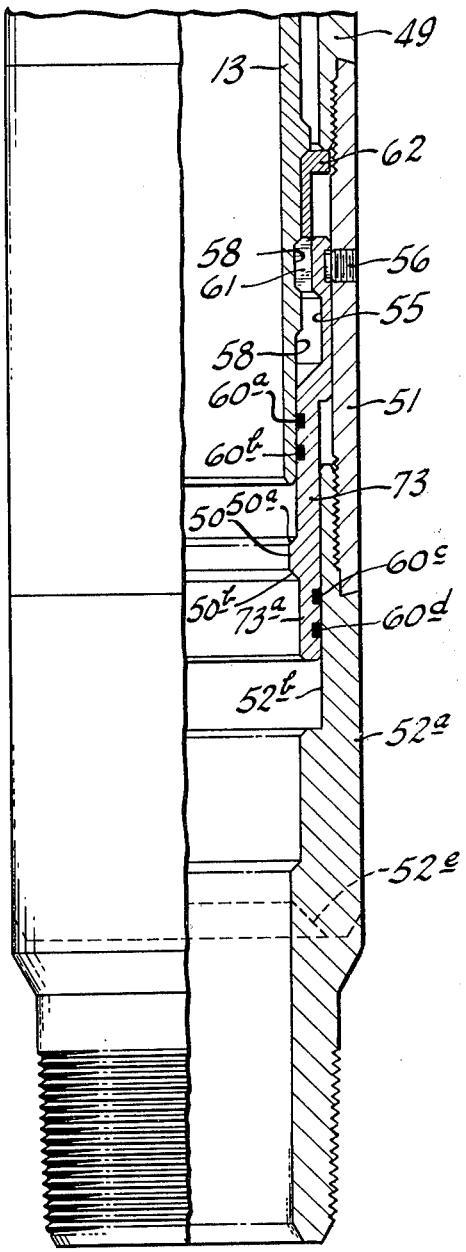
FIG. 7 is a view partly in elevation and partly in section of a further modified form of latch.

In FIG. 7, a universal form of latch is provided. The shear sleeve 51 and connector 49 are as previously explained as is the latch sleeve 13 and the latch ring 61 and shear pin 56. The ring retainer 73 is substantially identical to the ring retainer 53 of FIGS. 1B and 2B except that it has a greater length at 73*a* below the internal flange 50. The bottom sleeve 52*a* has its bore 52*b* extending down below the lower end of the ring retainer 73 to provide room for the ring retainer 73 to move downwardly so that the internal land 54 on the upper end thereof will clear the latch ring 61. As shown in dotted lines at 52*e*, the lower sub could terminate substantially as shown in FIGS. 1B and 2B or a thread may be provided thereon for connection to a tail pipe such as shown in FIG. 6.

With the form of latch shown in FIG. 7, a running tool may be engaged with the upper shoulder 50*a* provided by flange 50 to drive the ring retainer 73 downwardly shearing pin 56 and releasing the latch ring. In like manner, the tool may engage the downwardly facing shoulder 50*b* to drive the ring retainer 73 upwardly shearing pin 56 and releasing the latch ring 61. As a third alternative, a plug may be landed in the lower sub or at a point below the lower sub to close off the lower end of the tool and by increasing pressure through the tubing against the pressure responsive member provided by the O-rings 60*a*, 60*b*, 60*c* and 60*d* which in effect, make the lower end of the ring retainer a piston, the retainer may be driven upwardly to shear the pin 56 and release the latch ring 61.

The foregoing disclosure and description of the invention are illustrative and explanatory thereof and various changes in the size, shape and materials, as well as in the details of the illustrated construction may be made within the scope of the appended claims without departing from the spirit of the invention.

What is claimed is:

1. A latch for a well tool comprising, a mandrel including a latch sleeve having an external groove therein, a split latch ring in said groove, an outer sleeve telescoped over the lower end of the latch sleeve and having a stop shoulder preventing upward movement of the latch ring relative to the outer sleeve, a ring retainer slidable over the latch sleeve and within the outer sleeve and having an internal retainer land for engagement with said latch ring to retain it in said groove, means releasably positioning said ring retainer with the retainer land in engagement with said latch ring, and seal means between said ring retainer and each of said outer sleeve and latch sleeve to provide fluid integrity between said latch sleeve and said outer sleeve.

2. The latch of claim 1 wherein said seal means provides a piston for shifting said ring retainer to latch ring released position and said ring retainer has an internal shifting shoulder below said latch sleeve engageable by a shifting tool to move the ring retainer to latch ring release position.

3. The latch of claim 1 wherein said ring retainer has an internal shifting shoulder below said latch sleeve for engagement by a shifting tool to move said ring retainer to latch ring release position.

4. The latch of claim 1 or 2 wherein said ring retainer has upper and lower internal shifting shoulders for engagement by a shifting tool to move said ring retainer to latch ring release position.

5. The latch ring claim 1, 2 or 3 wherein said releasable positioning means is a shear pin.

6. The latch ring of claim 4 wherein said releasable positioning means is a shear pin.

7. A well packer comprising, a mandrel including a latch sleeve having an external groove therein, a releasable slip and seal means carried by said mandrel for sealingly engging a well and released by upward movement of the mandrel relative to the slip and seal means, a split latch ring in said groove, an outer sleeve carried by the releasable slip and seal means and telescoped over the lower end of the latch sleeve and having a stop shoulder preventing upward movement of the latch ring relative to the outer sleeve, a ring retainer slidable over the latch sleeve and within the outer sleeve and having an internal retainer land for engagement with said latch ring to retain it in said groove, means releasably positioning said ring retainer with the retainer land in engagement with said latch ring, and seal means between said ring retainer and each of said outer sleeve and latch sleeve to provide fluid integrity between said latch sleeve and said outer sleeve.

8. The latch of claim 7 wherein said seal means provides a piston for shifting said ring retainer to latch ring release position and said ring retainer has an internal shifting shoulder below said latch sleeve engageable by a shifting tool to move the ring retainer to latch ring release position.

9. The latch of claim 7 wherein said ring retainer has an internal shifting shoulder below said latch sleeve for engagement by a shifting tool to move said ring retainer to latch ring release position.

10. The latch of claim 7 or 8 wherein said ring retainer has upper and lower internal shifting shoulders for engagement by a shifting tool to move said ring retainer to latch ring release position.

11. The latch ring of claim 10 wherein said releasable positioning means is a shear pin.

12. The latch ring claim 7, 8 or 9 wherein said releasable positioning means is a shear pin.

* * * * *